United States Patent [19]

Rogers, Jr. et al.

[11] Patent Number: 4,691,961

[45] Date of Patent: Sep. 8, 1987

[54] RECLINER WITH HEADREST

[75] Inventors: Walter C. Rogers, Jr., Denton; Raymond E. Holobaugh, Jamestown, both of N.C.

[73] Assignee: Parma Corporation, Denton, N.C.

[21] Appl. No.: 829,209

[22] Filed: Feb. 14, 1986

[51] Int. Cl.[4] ..... A47C 1/036

[52] U.S. Cl. ..... 297/61; 297/396; 297/403

[58] Field of Search ..... 297/61, 391, 396, 403, 297/408

[56] References Cited

U.S. PATENT DOCUMENTS

| | | | |
|---|---|---|---|
| 2,859,797 | 11/1958 | Mitchelson | 279/61 |
| 2,996,332 | 8/1961 | Kurtyka et al. | 297/61 |
| 3,132,894 | 5/1964 | Schliephacke | 297/61 |
| 3,836,197 | 9/1974 | Goff et al. | 297/61 X |
| 3,942,835 | 3/1976 | Harrison | 297/61 |
| 4,188,062 | 2/1980 | Rogers, Jr. et al. | 297/403 X |

FOREIGN PATENT DOCUMENTS

| | | | |
|---|---|---|---|
| 1429273 | 2/1969 | Fed. Rep. of Germany | 297/403 |

*Primary Examiner*—Kenneth J. Dorner
*Assistant Examiner*—Peter R. Brown
*Attorney, Agent, or Firm*—William E. Mouzavires

[57] ABSTRACT

In a one-way recliner chair of the type having a stationary backrest frame which extends upwardly behind a movable backrest, a headrest is mounted on the top of the stationary backrest frame for movement between a retracted position when the chair is in the normal position, and a projected position when the chair is in the reclining position. The headrest is automatically actuated between the aforesaid positions by means of a linkage interconnecting the headrest and the movable backrest upon movement of the latter between a normal or generally upright position and a reclining position.

9 Claims, 5 Drawing Figures

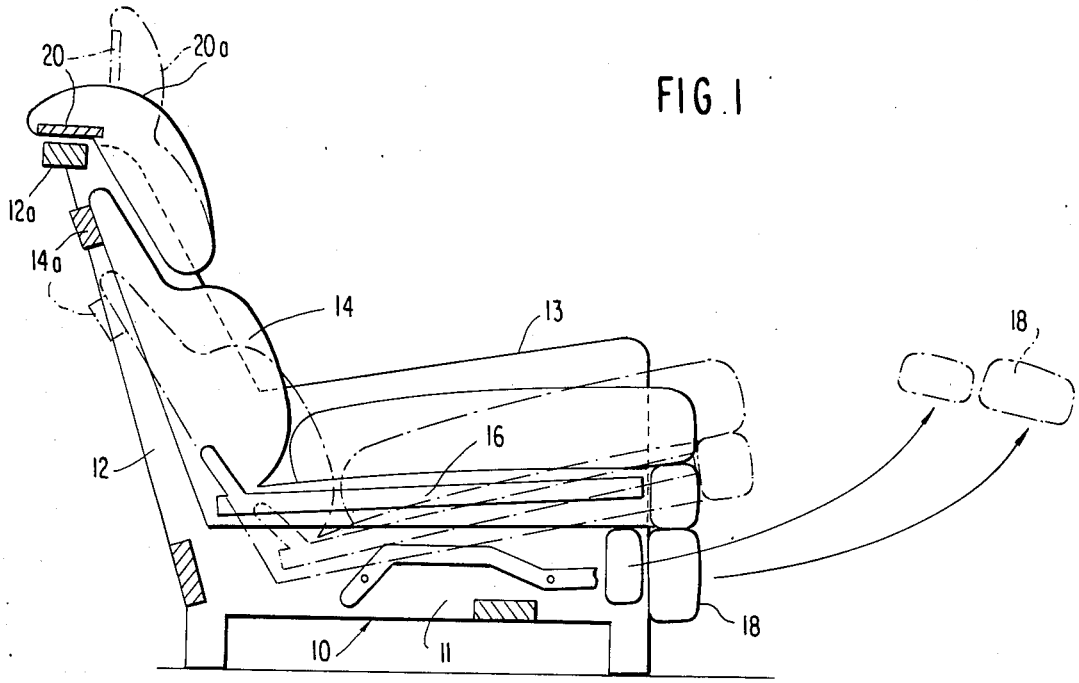
FIG. 1
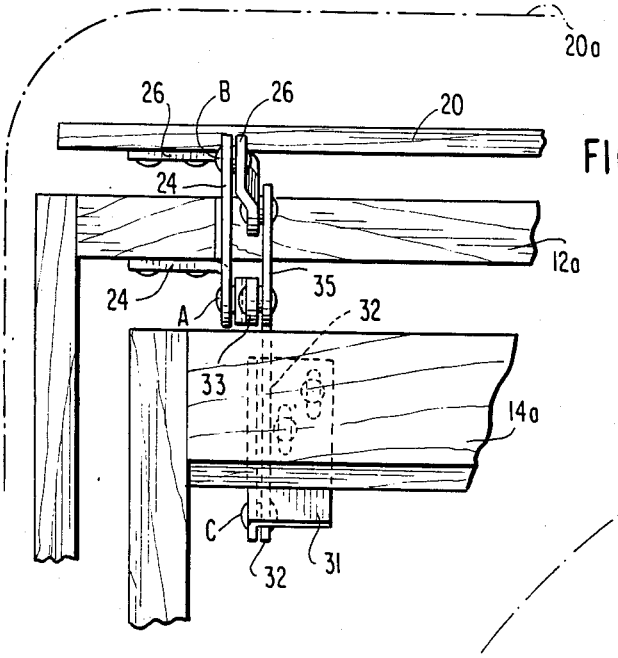
FIG. 2
FIG. 3
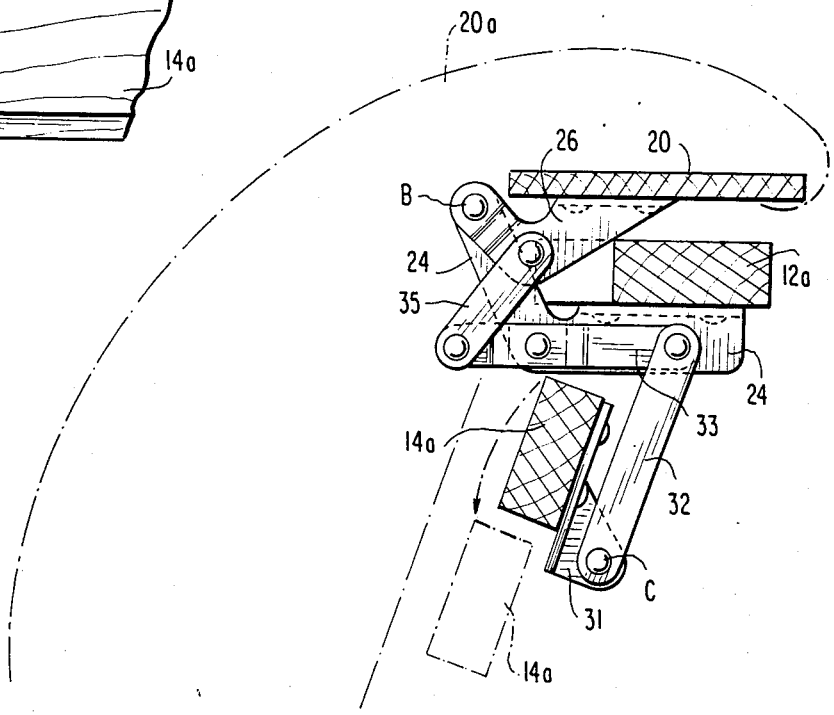

RECLINER WITH HEADREST

BACKGROUND OF INVENTION

Headrests for recliner chairs or seating units are of course well-known in the prior art. Such headrests are provided in "two-way" or "three-way" recliners such as exemplified in U.S. patents to Rogers No. 3,652,125 and Harrison No. 3,937,518 or in "one-way" recliners such as exemplified in U.S. patents to Bontempi et al No. 2,984,293, Kurtyka et al No. 3,996,332, and Schliepacke No. 3,147,037. In both examples, the headrest is typically mounted to the backrest to be actuated in response to movement of the chair to reclining position. Actuation of the headrest is achieved through a mechanism, typically a linkage mechanism, located in the backrest frame and extending downwardly to the base frame. In the earlier types of headrest recliners, such as disclosed in Bontempi et al U.S. Pat. No. 2,984,293, the headrests were mounted within the backrest frame to be projected in response to movement of the chair to reclining position. In later types such as disclosed in Rogers U.S. Pat. No. 3,652,125, secondary backrests with an upper headrest portion were provided on the rear side of a primary backrest. Such secondary backrests, however, increased the depth of the backrest and also prevented the chair from being placed close to a wall without the secondary backrest striking the wall when moving to extended position.

Furthermore, both types of headrest arrangements imposed certain design and dimensioning requirements of the backrest in order to accommodate the headrest mounting and actuating mechanisms within the backrest frame or rearwardly thereof. Moreover, in several of such prior art arrangements when the headrest was extended, an unsightly gap would appear in the backrest or between the backrest and the headrest. In addition, portions of the linkage would be exposed to detract from the appearance of the chair. Furthermore, such design requirements made it difficult, if not impossible, to integrate the headrest and the backrest into a common upholstery cover and hence, the headrest, when extended appeared as a part distinct from the backrest.

More recently, with the advent of "motion furniture", it has become common for motion sofas to incorporate recliner seating units. Because of the low back styling requirements of modern day sofas, headrests have been provided on recliner portions thereof in order to compensate for the low backrest styling. However, due to the design restrictions of conventional headrest arrangements as noted above, automatically actuated headrests heretofore provided for sofa units have been found to detract from the appearance of the sofa unit. The headrests heretofore available and which allowed acceptable appearance and wall proximity for sofa units have been typically manually operated. Some also suffered from inadequate back or head support requiring the addition of a pillow to provide the desired support.

OBJECTS OF THE INVENTION

An object of the present invention is to provide a novel and improved headrest mechanism that may be incorporated in a recliner seating unit such as a chair or as a portion of a sofa without the drawbacks of conventional headrest mechanisms heretofore experienced in the art as noted above. Included herein is the provision of a recliner seating unit such as a recliner chair or a portion of a sofa which incorporates the aforementioned headrest mechanism.

A further object of the present invention is to provide a recliner seating unit which incorporates a headrest mechanism that may be integrated with the backrest of a seating unit under a common upholstery cover to improve the appearance of the seating unit. Included herein is such a seating unit wherein the headrest mechanism is automatically extended when the seating unit is moved to reclining positions and without detracting from the appearance of the seating unit.

A further object of the present invention is to provide a novel headrest mechanism that may be incorporated in a sofa with low-back styling where it will not detract from the appearance of the sofa and moreover, will permit the sofa back to be placed adjacent a wall without the headrest striking the wall when actuated to the projected position for use.

A still further object of the present invention is to provide a novel and improved headrest mechanism that may be incorporated in a recliner chair or sofa, of the type having a stationary backrest and movable backrest mounted forwardly of the stationary backrest. Included herein is such a headrest mechanism that may be advantageously incorporated into "one-way" or "two-way" recliner seating units wherein the movable backrest is fixed relative to the seat to move with the seat to reclining position.

A still further object of the present invention is to provide a novel and improved headrest mechanism for recliner seating units that is easily and quickly actuated over a relatively short path of movement in unison with movement of the seating unit to reclining position. Included herein is such a headrest mechanism that is relatively compact being possessed of a minimum of parts and which will provide comfortable head support even in low-back recliner seating units.

SUMMARY OF INVENTION

The present invention provides a recliner seating unit having a headrest mounted to a stationary backrest frame to be movable between a retracted position when the seating unit is in generally upright position, and a projected position when the seating unit is in reclining position. The headrest is automatically actuated between the aforesaid positions by a novel linkage mechanism interconnecting the headrest and a movable backrest. The linkage mechanism is driven by the movement of the movable backrest relative to the stationary backrest frame. In one preferred embodiment of the invention, the headrest extends generally horizontally across the top of the stationary backrest frame when the seating unit is in the upright position, and projects generally vertically above the top of the stationary backrest frame as an extension of the movable backrest when the seating unit is in reclining position. Also, in the preferred embodiment, the headrest and movable backrest are integrated under a common upholstery cover.

DRAWINGS

Other objects and advantages of the present invention will become more apparent from the following more detailed description in conjunction with the drawings in which:

FIG. 1 is a side elevational view of a recliner seating unit incorporating a headrest embodying the present invention and shown with phantom lines indicating a reclining position of the seating unit;

FIG. 2 is an enlarged front elevational view in fragment of the seating unit with the headrest in retracted position;

FIG. 3 is a side elevational view in fragment of the headrest when in the same position as shown in FIG. 2;

DETAILED DESCRIPTION

Figure 4:
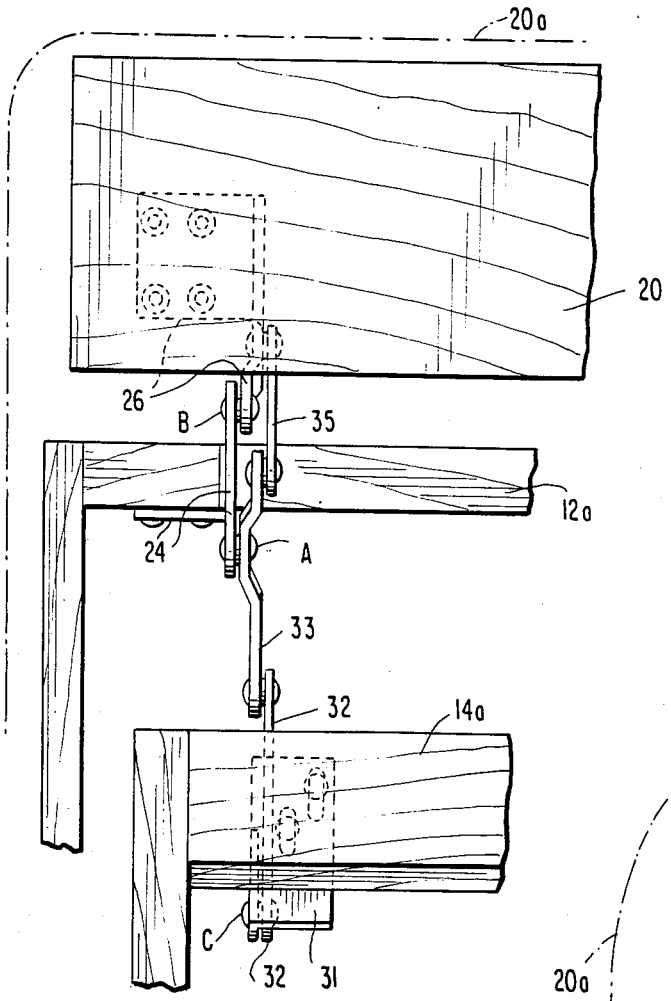
FIG. 4 is a view similar to FIG. 2 but with the headrest in the extended position.

Referring to the drawings in detail, there is shown in FIG. 1 for illustrative purposes only, a one-way reclining chair embodying the present invention. The chair typically includes a stationary frame generally designated 10 including a base frame 11 and a backrest frame 12 fixed to base frame 11 and projecting upwardly at the rear thereof. Also fixed to the base frame to be stationary are armrests 13. Movable on the frame 10 between the armrests 13 is a seat including seat frame 16 and a backrest frame 14 fixed to the seat frame 16 to move with it as a unit between a normal or upright position shown in solid lines in FIG. 1 and a reclining position shown in phantom lines in FIG. 1. The chair may include a footrest 18 movable between retracted and extended positions upon movement of the seat between upright and reclining positions. Although not shown in detail, any suitable or conventional linkage mechanism may be used to mount the seat frame to the base frame for movement between the aforementioned positions. The same is true with respect to the footrest 18. In addition, the seat may be actuated between the upright and reclining position by any suitable or conventional means such as a handle, actuator, a push or pull off the armrests actuator or a backrest actuator. Inasmuch as the structure described above thus far forms no part of the present invention and may comprise well-known elements of the prior art, a further detailed description of the same is not believed to be necessary except to note that reference to U.S. Pat. No. 4,357,049 to Robers et al may be had for a disclosure of one type of linkage mechanism which may be employed for mounting and actuating the seat and footrest. The disclosure of said U.S. Pat. No. 4,357,049 is hereby incorporated herein by reference and made a part hereof.

Figure 5:
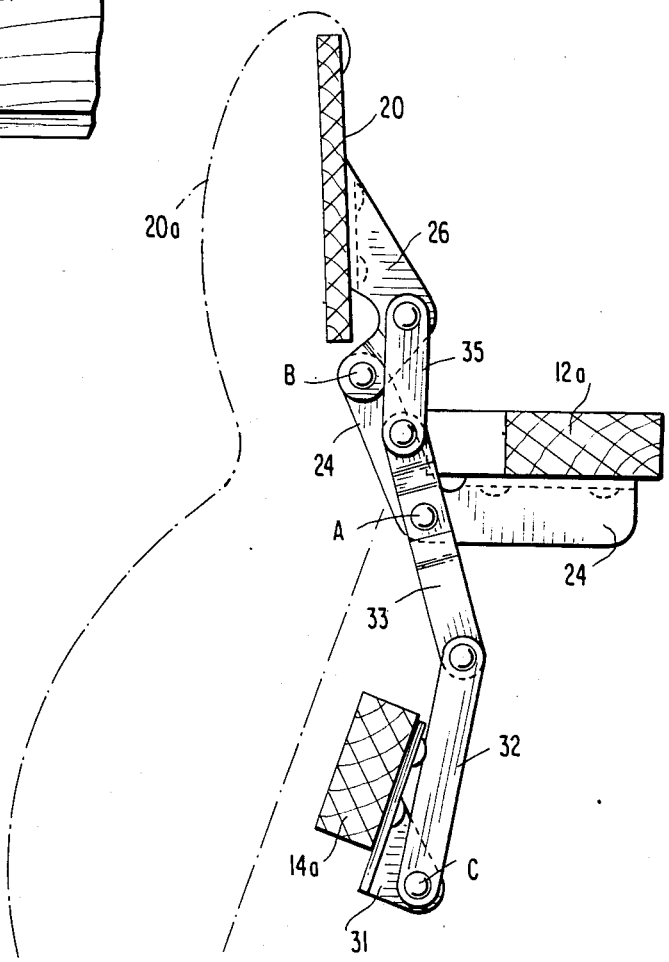
FIG. 5 is a view similar to FIG. 3 but with the headrest in the extended position.

In accordance with the present invention, a headrest 20 is provided on the stationary backrest frame 12 to be automatically movable between a retracted position shown in FIGS. 2 and 3 and a projected position shown in FIGS. 4 and 5 in response to movement of the backrest 14 between upright and reclining positions. To this end, a linkage mechanism is interconnected between the headrest 20 and the movable backrest 14 to drive the headrest 20. In the preferred embodiment shown, the headrest 20 is mounted to the cross-rail **12*a* of the stationary backrest frame 12 by means of a bracket link 24 fixed to the underside of rail 12*a* and having a forward and upwardly projecting portion pivotally connected at B to a bracket link 26 fixed to the headrest 20. In the preferred embodiment, the headrest actuating linkage includes a bracket link 31 fixed to the rear side of the cross-rail 14*a* of the movable backrest 14, a connecting link 32 situated rearwardly of the cross-rail 14*a* and being pivotally connected at one end to bracket link 31. The other end of connecting link 32 is pivotally connected to one end of a crank link 33 which is pivotally mounted intermediate its ends at A to bracket link 24. The other end of crank link 33 is pivotally connected to one end of a short link 35 whose other end is pivotally connected to bracket link 26 intermediate the ends of the latter. Although one linkage system has been shown and described above, it should be understood that in the preferred embodiment two such systems are provided at opposite side portions of the movable backrest 14*a* and the stationary backrest frame 12*a***.

In the preferred embodiment, the upholstery **20*a* of the headrest 20 is integrated with that of the movable backrest frame 14 so that the headrest linkage is concealed and there is no visible gap between the stationary backrest frame 12*a* and the movable backrest 14*a***. Although not shown, other forms and designs of the headrest upholstery may be employed.

In the normal or upright position of the chair shown in FIGS. 2 and 3, the backrest frame 20 lies in a generally horizontal plane across the top of the rail **12*a* of the stationary backrest frame. Also, the bracket link 24 extends generally horizontally below the plane of the rail 12*a*. When the backrest 14 moves into reclining position, connecting link 32 moves downwardly to pivot crank link 33 (clockwise as viewed in FIGS. 3 and 5) about axis A causing short link 35 to pivot the headrest (counterclockwise) upwardly about fixed axis B, a distance of about ninety degrees (90°)to the position shown in FIG. 5. When the chair is returned to the normal or generally upright position, the headrest linkage will be automatically actuated to return the headrest to the position shown in FIG. 3**.

It will therefore be seen that the present invention provides a compact linkage for the headrest requiring a minimum amount of movement of the headrest between positions thereof and without detracting from the esthetic appearance of the associated seating unit. Indeed, the present invention allows the same upholstery to cover both the headrest and the movable backrest so that the headrest is hardly noticeable as a headrest when retracted and appears as a continuous extension of the movable backrest when extended. The present invention may also be incorporated in various recliner designs including sofa units which may be positioned close to a wall without interference with the headrest or backrest.

We claim:

1. A recliner seating unit comprising a stationary frame including a base, a movable seat and a movable backrest mounted on the frame for movement between a generally upright position and a reclined position, said stationary frame including a fixed backrest mounting portion located above the base and behind an upper portion of the backrest, a headrest mounted to the headrest mounting portion for pivotal movement between a retracted generally horizontal position when the backrest is in the upright position and an extended generally vertical position overlying the backrest when the backrest is in the reclined position, and means for pivoting said headrest about a first axis located at a forward portion of the headrest mounting portion for moving the headrest between said retracted and extended positions upon movement of the backrest between said upright and reclined position, and wherein said headrest generally overlies and headrest mounting portion when in the retracted position and projects vertically upwardly from the headrest mounting portion when in the extended position, and said headrest positions are spaced from each other approximately ninety degrees, and wherein said means for actuating said headrest includes a linkage interconnecting the backrest and the headrest, and wherein said linkage includes a first bracket link fixed to the headrest, a second bracket link fixed to said fixed headrest mounting portion and extending forwardly of said headrest mounting portion for providing said first axis about which said headrest pivots, said first bracket link being pivotally mounted to said second bracket link at said first axis, a crank pivoted intermediate its ends to said second bracket link for rotational movement about a second axis spaced from said first axis relative to the headrest mounting portion, a link pivotally interconnected between one end of said crank and said first bracket link on one side of said second axis, and a link pivotally interconnected between the other end of said crank and the backrest on the opposite side of said second axis.

2. The recliner seating unit defined in claim 1 wherein said headrest generally overlies said headrest mounting portion when in the retracted position and projects vertically upwardly from the headrest mounting portion when in the extended position.

3. The recliner seating unit defined in claim 1 including upholstery covering both of said headrest and a front portion of said backrest.

4. The recliner seating unit defined in claim 1 including a footrest movable between a retracted position and an extended position when said seat and backrest move between said upright and reclined positions thereof.

5. The recliner seating unit defined in claim 4 wherein said seat and backrest are fixed to each other for movement together as a unit relative to the frame.

6. The recliner seating unit defined in claim 1 wherein said seat and backrest are fixed to each other for movement together as a unit relative to the frame.

7. The recliner seating unit defined in claim 1 wherein said stationary frame includes a fixed backrest fixed to the base and located behind the movable backrest, said headrest mounting portion being located on the fixed backrest.

8. The recliner seating unit defined in claim 7 wherein said headrest mounting portion is located on the top of the fixed backrest.

9. For use in a recliner seating unit, a headrest mechanism comprising a headrest, a first mounting link (26) fixed to the headrest, a second mounting link (24) adapted to be fixed to a stationary frame and extending forwardly to provide a first pivot axis, said first mounting link being pivotally mounted to said second mounting link at said first pivot axis, a crank link (33) pivotally mounted intermediate its ends to the second mounting link for rotational movement about a second pivot axis spaced from said first axis, a link (35) pivotally interconnecting one end of said crank link and said first mounting link on one side of said second axis to drive the headrest upon actuation of said crank link, an actuating link (32) pivotally connected to the other end of the crank link (33) on the opposite side of said second axis and adapted to be connected to a movable backrest of an associated recliner seating unit to drive the crank link upon movement of the backrest into a reclined position, and wherein the headrest is movable approximately ninety degrees between a retracted position where it extends in a generally horizontal plane and a projected position where it extends in a generally vertical plane.

* * * * *